US009085406B2

(12) United States Patent
Decker et al.

(10) Patent No.: US 9,085,406 B2
(45) Date of Patent: Jul. 21, 2015

(54) BOTTOM DISPENSING CARTON

(75) Inventors: Kip K. Decker, Neenah, WI (US); Abby Case, Green Bay, WI (US); Walter O. Wruck, Neenah, WI (US)

(73) Assignee: Georgia-Pacific Consumer Products LP, Atlanta, GA (US)

( * ) Notice: Subject to any disclaimer, the term of this patent is extended or adjusted under 35 U.S.C. 154(b) by 0 days.

(21) Appl. No.: 13/604,761

(22) Filed: Sep. 6, 2012

(65) Prior Publication Data

US 2013/0062362 A1 Mar. 14, 2013

Related U.S. Application Data

(60) Provisional application No. 61/532,184, filed on Sep. 8, 2011.

(51) Int. Cl.
*B65D 5/72* (2006.01)
*B65D 83/08* (2006.01)

(52) U.S. Cl.
CPC ..... *B65D 83/0847* (2013.01); *B65D 5/726* (2013.01)

(58) Field of Classification Search
CPC ..... B65D 83/0847
USPC ..... 221/45; 206/449; 229/185.1
See application file for complete search history.

(56) References Cited

U.S. PATENT DOCUMENTS

| | | | | |
|---|---|---|---|---|
| 2,115,673 | A * | 4/1938 | Stompe | 248/612 |
| 2,216,324 | A * | 10/1940 | Ringler | 221/45 |
| 2,297,571 | A * | 9/1942 | Lowey | 229/120.18 |
| 2,319,018 | A * | 5/1943 | Ullman | 229/131 |
| 2,827,057 | A * | 3/1958 | Feeley | 206/459.5 |
| 4,151,946 | A * | 5/1979 | Schmidt et al. | 229/221 |
| 4,605,128 | A * | 8/1986 | Rieke | 229/242 |
| 4,877,154 | A | 10/1989 | Matsui | |
| 5,908,153 | A * | 6/1999 | Greer et al. | 229/122.2 |
| 6,422,416 | B1 | 7/2002 | Tramontina | |
| 6,598,737 | B2 * | 7/2003 | Rudnick | 206/63.3 |
| 7,611,014 | B2 * | 11/2009 | Bobe et al. | 206/494 |
| 8,382,096 | B2 * | 2/2013 | Suito et al. | 271/145 |
| 2007/0170197 | A1 | 7/2007 | Decker et al. | |
| 2008/0035663 | A1 | 2/2008 | Byle et al. | |
| 2010/0114366 | A1 | 5/2010 | Case et al. | |
| 2010/0180370 | A1 * | 7/2010 | Helewa | 4/484 |
| 2010/0258580 | A1 | 10/2010 | Decker et al. | |
| 2011/0174834 | A1 | 7/2011 | Case et al. | |

* cited by examiner

*Primary Examiner* — Patrick Mackey
(74) *Attorney, Agent, or Firm* — Michael V. Kruljac

(57) ABSTRACT

The present application provides a dispensing carton for a number of sheet products therein. The dispensing carton may include a first wall, a dispensing aperture positioned in the first wall, a perpendicular second wall, and one or more support tabs positioned in the perpendicular second wall. The support tabs may be folded within the perpendicular second wall to support the number of sheet products therein.

20 Claims, 4 Drawing Sheets

BOTTOM DISPENSING CARTON

RELATED APPLICATIONS

The present application claims priority to provisional application Ser. No. 61/532,184, entitled "BOTTOM DISPENSING CARTON", filed on Sep. 8, 2011. Provisional application Ser. No. 61/532,184 is incorporated herein by reference in full.

TECHNICAL FIELD

The present application and the resultant patent relate generally to a dispensing carton for sheet products and more particularly relate to a bottom dispensing carton with support tabs formed in one or more sidewalls.

BACKGROUND OF THE INVENTION

Sheet products, such as wipers, napkins, facial tissues, towels, and the like, may be packed, distributed, and dispensed in a carton-type dispenser. The carton-type dispenser generally has a dispensing opening on one end through which the individual sheets may be removed sequentially by the user. The sheets may be overlapped and/or interfolded such that pulling a leading sheet through the opening results in a subsequent sheet being pulled partially through the opening via friction or perforation tabs and ready for use.

The dispensing opening of the carton may be oriented at the top, the sides, and/or the bottom of the carton. One issue in bottom dispensing, however, is the downward force of the weight of the stack of sheets therein. Specifically, the weight of the stack may exceed machine direction tensile strength of the bottom sheet. The bottom sheet thus may fail via tearing or tabbing when the user attempts to remove the bottom sheet from the carton.

There is thus a desire for an improved carton-type dispenser. Preferably, such a carton-type dispenser may be versatile in dispensing sheet products in any orientation. Specifically, the carton-type dispenser may provide bottom dispensing without allowing the bottom sheets to tear, tab, or otherwise fail when being removed therefrom.

SUMMARY OF THE INVENTION

The present application and the resultant patent thus provide a dispensing carton for a number of sheet products therein. The dispensing carton may include a first wall, a dispensing aperture positioned in the first wall, a perpendicular second wall, and one or more support tabs positioned in the perpendicular second wall. The support tabs may be folded within the perpendicular second wall to support the number of sheet products therein.

The present application and the resultant patent further provide a method of dispensing a stack of sheet products from a dispensing carton. The method may include the steps of opening a dispensing aperture on the dispensing carton, deploying one or more support tabs within a sidewall of the dispensing carton, positioning the dispensing carton with the dispensing aperture on a bottom of the dispensing carton, supporting a portion of the stack of sheet products with the one or more support tabs so positioned, and dispensing a leading sheet of the stack of sheet products through the dispensing aperture.

The present application and the resultant patent further provide for a blank for use in erecting a dispensing carton. The blank may include a bottom panel, a dispensing aperture positioned in the bottom panel, a side panel, and one or more support tabs positioned in the side panel. The one or more support tabs may include a half moon like shape.

These and other features and improvements of the present application and the resultant patent will become apparent to one of ordinary skill in the art upon review of the following detailed description when taken in conjunction with the several drawings and the appended claims.

DETAILED DESCRIPTION

As used herein, the term "sheet products" includes natural and/or synthetic cloth or paper sheets. Sheet products may include both woven and non-woven articles. Examples of sheet products include, but are not limited to, wipers, napkins, tissues, towels, and other types of fibrous, film, polymer, or filamentary products and the like. Such sheet products generally are thin in comparison to their length and breadth. The sheet products may exhibit a relatively flat planar configuration and may be flexible to permit folding, rolling, stacking, and the like. The sheet products may be releasably attached to each other. Suitable releasable attachment means include, but are not limited to, friction, cohesion, or other forces that releasably attach adjacent articles. Perforations upon the sheets may provide such releasable detachment. The sheets also may be interfolded such that releasable attachment may result from friction or cohesion between adjacent sheets. The scope of the present application is not limited by the nature of the sheet products.

Figure 1:
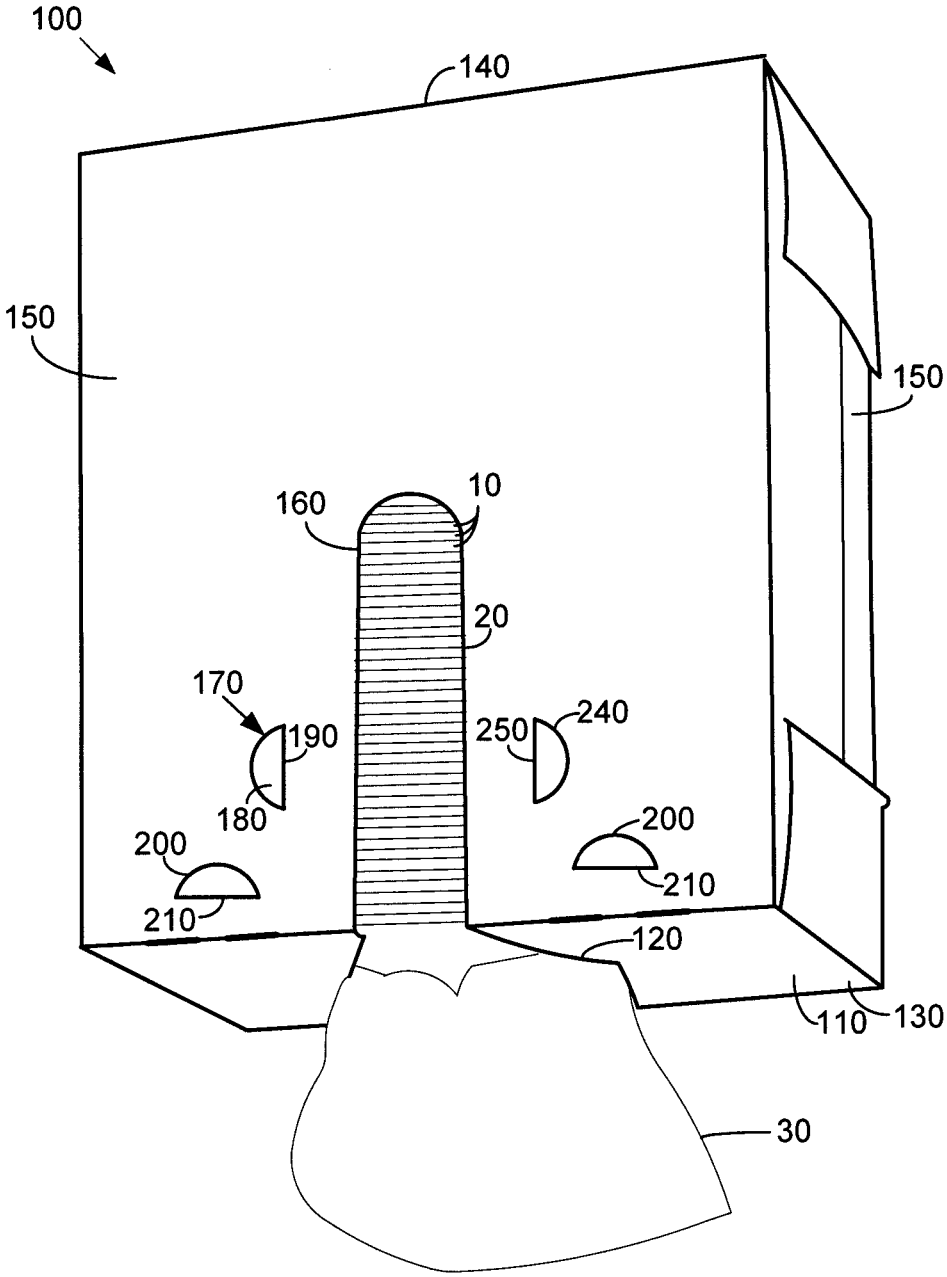
FIG. 1 is a perspective view of a dispensing carton as may be described herein.
Figure 2:
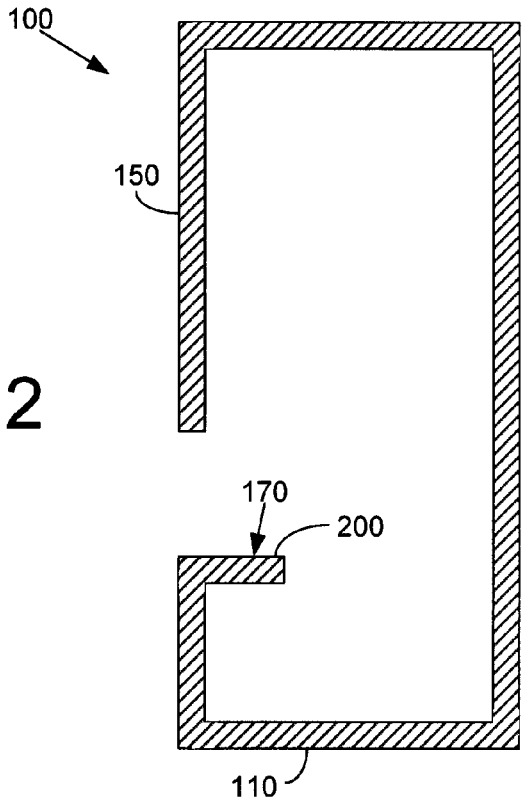
FIG. 2 is a side cross-sectional view of the dispensing carton of FIG. 1.
Figure 3:
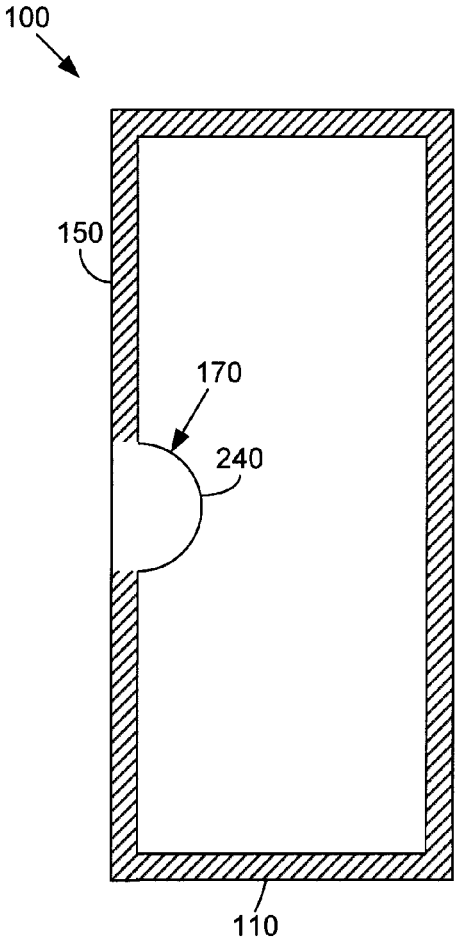
FIG. 3 is a further side cross-sectional view of the dispensing carton of FIG. 1.

Referring now to the drawings, in which like numerals refer to like elements throughout the several views, FIGS. 1-3 show a carton dispenser 100 as may be described herein. The carton dispenser 100 may be portable and light in weight. The carton dispenser 100 may be a rigid container, a semi-rigid container, a flexible container, or any combination thereof. The materials for the dispenser 100 may vary depending upon the desired application. Suitable materials include, but are not limited to, paperboard, thermoplastics, and the like. Suitable paperboard products include cardboard, corrugated cardboard, fiberboard, and composite materials. The paperboard may be combined or treated with one or more additional materials to improve the strength, water resistance, color fastness, or other characteristics. For example, the paperboard may be coated or impregnated with one or more resins or polymeric materials such as waxes, polyolefins, polyvinylidine chlorides, polyvinyl chlorides, and the like. Further, the paperboard products may be a laminated or a multi-layer material. As described in more detail below, the carton dispenser 100 may be formed from a single sheet of paperboard blank stock and folded into a substantially rectangular container. The carton dispenser 100 may have any desired size, shape, or configuration. Specifically, the carton dispenser 100 may be sized according to the size, shape, configuration of the intended sheet products 10 and the desired volume thereof.

The carton dispenser 100 may have a dispensing wall 110. The dispensing wall 110 may include a dispensing aperture 120 formed therein. As will be described in more detail below, the dispensing aperture 120 may be formed in the dispensing wall 110 via a number of fold lines, tear lines, and the like. The dispensing aperture 120 may have any desired size, shape, or configuration. In this example, the dispensing wall 110 may be a bottom wall 130 although any wall may be used herein. The dispenser 100 also may include a top wall 140 opposite the bottom wall 130 and a number of perpendicular sidewalls 150 therebetween. The terms "bottom," "top," and "side" are for purposes of relative orientation only and not as an absolute position. Any wall may be used as the bottom, the top, or any of the sides as positioned by the user. One or more of the sidewalls 150 also may have a dispensing slot 160 formed therein. The dispensing slot 160 may merge with the dispensing aperture 120 of the bottom wall 130. The dispensing slot 160 also may be formed via a number of fold lines, tear lines, and the like. The dispensing slot 160 may have any desired size, shape, or configuration.

Figure 4:
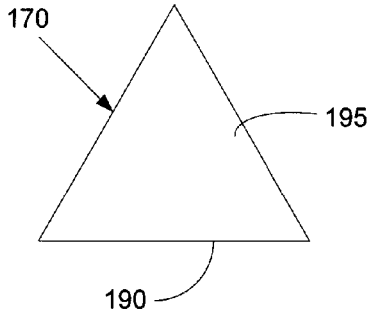
FIG. 4 is a plan view of a triangular tab as may be used with the dispensing carton of FIG. 1.

The carton dispenser 100 also may have a number of support tabs 170 formed therein. The support tabs 170 may be formed in any one or more of the sidewalls 150. The support tabs 170 may be formed by a number of fold lines, tear lines, and the like. Any number of support tabs 170 may be used herein in any orientation. The support tabs 170 may have a largely half moon like shape 180 although any desired size, shape, or configuration may be used herein. The half moon like shape 180 of the support tabs 170 may rotate about the sidewall 150 via a tab fold line 190. As is shown in FIG. 4, the support tabs 170 also may have a largely triangular shape 195 and the like. The triangular shape 195 of the support tabs 170 also may rotate about the sidewall 150 via the tab fold line 190. Other shapes and combinations of several shapes also may be used herein.

Figure 5:
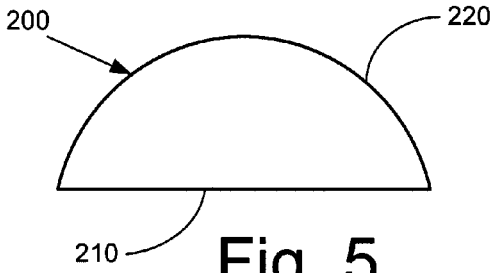
FIG. 5 is a plan view of an upward facing horizontal tab as may be used with the dispensing carton of FIG. 1.
Figure 6:
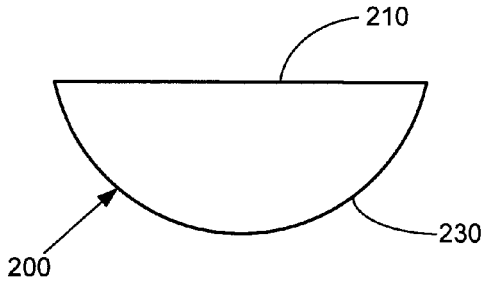
FIG. 6 is a plan view of a downward facing horizontal tab as may be used with the dispensing carton of FIG. 1.

As is shown in FIGS. 1, 2, 5, and 6, the support tabs 170 may take the form of one or more horizontal tabs 200. The horizontal tabs 200 may have a horizontal fold line 210. The horizontal tabs 200 may have a top flap 220 as is shown in FIG. 5 or a bottom flap 230 as is shown in FIG. 6. The horizontal tabs 200 thus rotate inward along the horizontal fold line 210 either downwardly or upwardly. Other configurations may be used herein.

Figure 7:
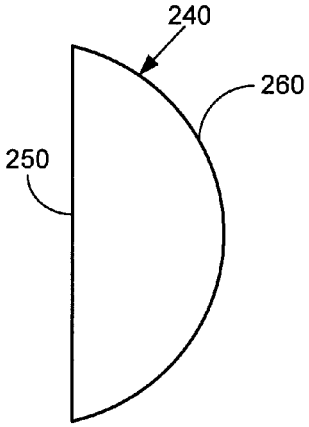
FIG. 7 is a plan view of a right facing vertical tab as may be used with the dispensing carton of FIG. 1.
Figure 8:
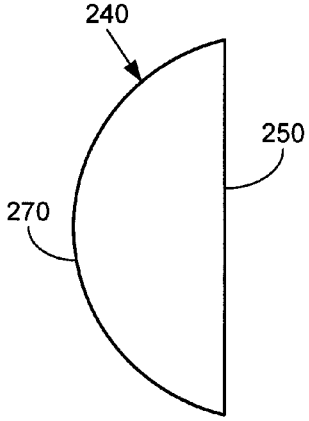
FIG. 8 is a plan view of a left facing vertical tab as may be used with the dispensing carton of FIG. 1.

As is shown in FIGS. 1, 3, 7, and 8, the support tabs 170 also may take the form of one or more vertical tabs 240. The vertical tabs 240 may rotate about a vertical fold line 250. As is shown in FIG. 7, the vertical tab 240 may have a right flap 260. As is shown in FIG. 8, the vertical tab 240 may have a left flap 270. The vertical tabs 240 thus rotate inward along the vertical fold line 250 either to the left or to the right. Other configurations may be used herein.

Figure 9:
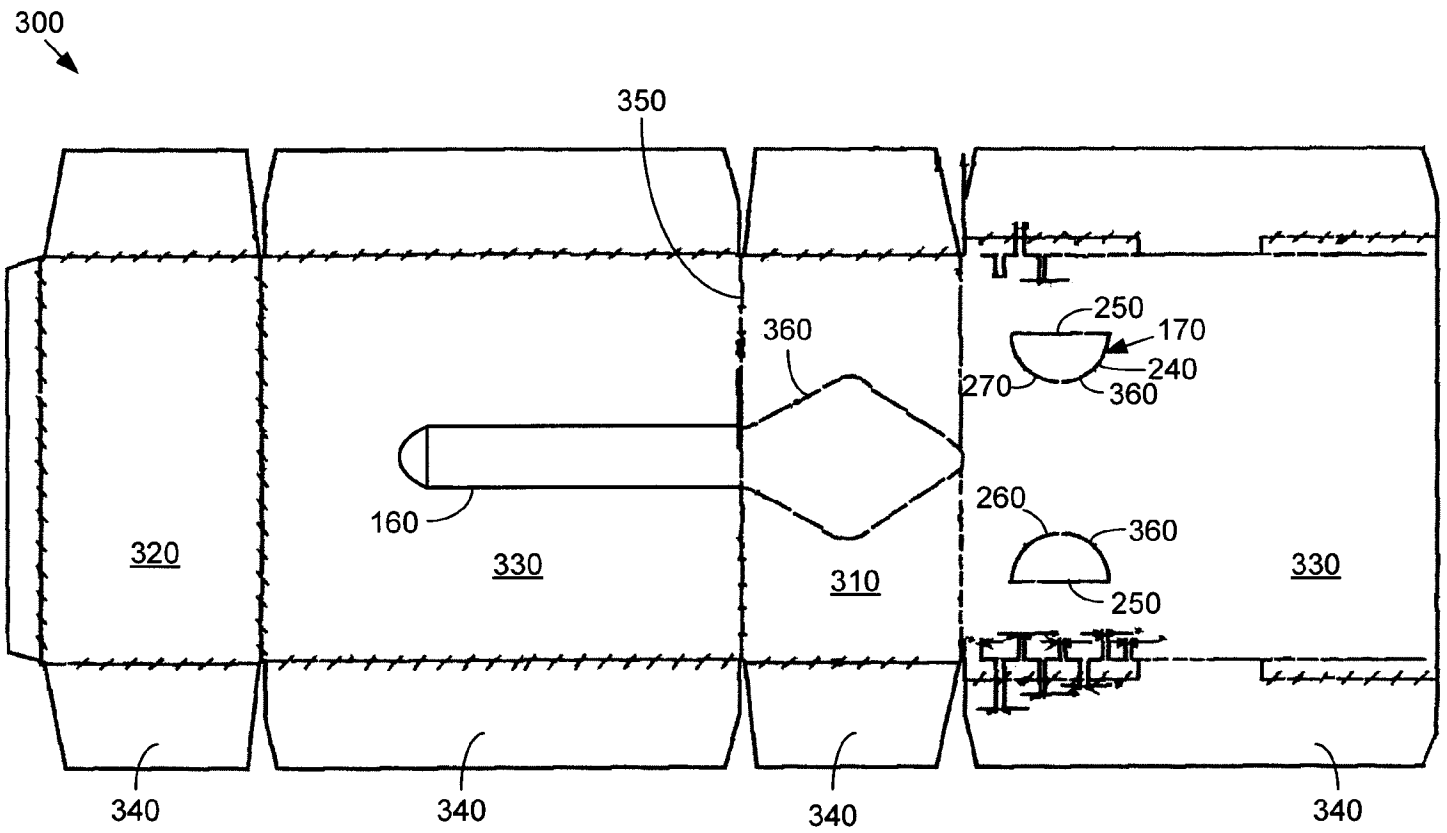
FIG. 9 is a top plan view of a blank as may be used to erect an alternative embodiment of a dispensing carton.

FIG. 9 shows a blank 300 that may be used to erect the dispensing carton 100 as is described herein and the like. The blank 300 may be die cut from a continuous sheet of material or from individual sheets. Other construction techniques may be used herein. Each blank 300 may have a number of fold lines and tear lines formed therein. The term "fold line" may refer to a weakened line that facilitates folding of the material along the length of the line. The fold line may include, but is not limited to, a score line, a perforation, a line of short slits, a line of half-cuts, a combination of slits and score lines, and similar arrangements. Any reference to a fold line or any type of hinged connection should not be construed as being limited to a single fold line. Any such fold line or hinged connection may be formed from one or more fold lines. The fold line may or may not be preformed or weakened. If not preformed or weakened, the fold line may be formed by the user by, for example, depressing a partially formed tab and the like. The term "tear" line may refer to a line of severance or any other type of weakened line that facilitates tearing or separation along the length of the weakened line. The tear line may include, but is not limited to, a perforation, a line of short slits, a line of half-cuts, a combination of slits and score lines, and similar arrangements.

The blank 300 may have a number of panels and flaps separated by a number of the fold lines. Specifically, the blank 300 may have a bottom panel 310, a top panel 320, a pair of side panels 330, and a number of side flaps 340 that correspond to the bottom wall 130, the top wall 140, and the side walls 150. The respective panels and flaps may be connected by a number of fold lines 350. The dispensing aperture 120 and the dispensing slot 160 may be formed by a number of tear lines 360.

In this example, one of the side panels 330 has a pair of support tabs 170 formed therein. Specifically, a pair of vertical tabs 240 are formed via the vertical fold lines 250 and a number of tear lines 360. Specifically, one right flap 260 and one left flap 270 are shown. Other configurations and other types of support tabs 170 may be used herein.

In use, the dispensing carton 100 may manufactured and erected in a conventional manner. The sheets 10 may be loaded within the dispensing carton 100 in a stack 20 and the dispensing carton 100 may be distributed as desired. The end user may decide to position the dispensing carton 100 in any orientation. If the end user elects to dispense via the top of the dispensing carton 100, the end user simply removes the dispensing aperture 120 such that the end user may dispense the sheets 10 therein in a conventional fashion.

If the end user elects a bottom dispense, however, the end user may deploy one or more of the support tabs 170. The end user presses along the half moon like shape 180, the triangular shape 195, or any other suitable shape of one or more of the support tabs 170 such that each support tab 170 rotates inward along the fold line 190. If the horizontal tabs 200 are used, one or more of the horizontal tabs 200 may be inserted between a pair of the sheets 10 in the stack 20. The horizontal tabs 200 thus serve to support the sheets 10 in the stack 20 above the horizontal tab 200 so as to lessen the force on a bottom leading sheet 30 and the other sheets 10 in the stack 20 beneath the horizontal tab 200. Similarly, if the vertical tabs 240 are used, the vertical tabs 240 serve to compress and support the sheets 10 therein. This compression also serves to support the sheets 10 in the stack 20 above the vertical tabs 240 so as to lessen the force on the leading sheet 30 and the sheets 10 below the vertical tab 240 in the stack 20.

Although FIG. 1 shows the use of both the horizontal tabs 200 and the vertical tabs 240, either or both of the horizontal tabs 200 and the vertical tabs 240 may be used herein. As such, FIG. 9 only shows the use of the vertical tabs 240. The support tabs 170 also may be used on more than one of any of the sidewalls 150. Likewise, the support tabs 170 may use the top flap 220, the bottom flap 230, the right flap 260, and/or the left flap 270 in any combination or orientation.

The dispensing carton 100 thus may be used in any orientation. The support tabs 170 need only be employed in the case of a bottom dispense. The support tabs 170 remain intact along the sidewall 150 during shipping and dispensing to ensure the quality of the sheet material 10 therein while not adding unnecessary components or weight therein. The support tabs 170 thus remain intact unless deployed by the end user. The support tabs 170 prevent tearing, tabbing, or other types of failure of the sheets 10 in a bottom dispense.

It should be apparent that the foregoing relates only to certain embodiments of the present application and the resultant patent. Numerous changes and modifications may be made herein by one of ordinary skill in the art without departing from the general spirit and scope of the invention as defined by the following claims and the equivalents thereof.

We claim:

1. A bottom dispensing carton, comprising:
a number of interfolded sheet products;
a first wall;
a dispensing aperture positioned in the first wall;
a perpendicular second wall;
a dispensing slot positioned in the perpendicular second wall; and
one or more product support tabs positioned in the perpendicular second wall above the dispensing aperture;
wherein the one or more product support tabs are folded within the perpendicular second wall to contact and support a portion of the number of sheet products.

2. The dispensing carton of claim 1, wherein the first wall comprises a bottom wall.

3. The dispensing carton of claim 1, wherein the perpendicular second wall comprises a side wall.

4. The dispensing carton of claim 1, wherein the one or more product support tabs comprise a half moon shape and/or a triangular shape.

5. The dispensing carton of claim 1, wherein the one or more product support tabs comprise a tab fold line.

6. The dispensing carton of claim 1, wherein the one or more product support tabs comprise one or more horizontal tabs.

7. The dispensing carton of claim 6, wherein the one or more horizontal tabs comprise a horizontal fold line.

8. The dispensing carton of claim 6, wherein the one or more horizontal tabs comprise a top flap.

9. The dispensing carton of claim 6, wherein the one or more horizontal tabs comprise a bottom flap.

10. The dispensing carton of claim 1, wherein the one or more product support tabs comprise one or more vertical tabs.

11. The dispensing carton of claim 10, wherein the one or more vertical tabs comprise a vertical fold line.

12. The dispensing carton of claim 10, wherein the one or more vertical tabs comprise a right flap.

13. The dispensing carton of claim 10, wherein the one or more vertical tabs comprise a left flap.

14. A method of dispensing a stack of sheet products from a bottom of a dispensing carton, such dispensing carton comprising two sidewalls and a bottom panel, the method comprising:
opening a dispensing aperture and a dispensing slot on the dispensing carton;
deploying one or more product support tabs within at least one sidewall of the dispensing carton such that the one or more product support tabs are in contact with the stack of sheet products therein;
positioning the dispensing carton with the dispensing aperture on the bottom panel and the product support tabs spaced apart from the bottom panel;
supporting a portion of the stack of sheet products with the one or more product support tabs; and
dispensing a leading sheet of the stack of sheet products through the dispensing aperture on the bottom panel with the dispensing slot on an adjacent sidewall.

15. A blank for use in erecting a dispensing carton for use with a number of interfolded sheet products, comprising:
a bottom panel;
a dispensing aperture positioned in the bottom panel;
a side panel;
a dispensing slot positioned on the side panel and
one or more product support tabs positioned in the side panel;
wherein the one or more product support tabs comprise a semi-circular shape and/or a triangular shape.

16. The dispensing carton of claim 15, wherein the one or more product support tabs comprise one or more horizontal tabs.

17. The dispensing carton of claim 16, wherein the one or more horizontal tabs comprise a horizontal fold line.

18. The dispensing carton of claim 15, wherein the one or more product support tabs comprise one or more vertical tabs.

19. The dispensing carton of claim 18, wherein the one or more vertical tabs comprise a vertical fold line.

20. A bottom dispensing carton, comprising:
a number of sheet products;
a first wall;
a dispensing aperture positioned in the first wall;
a perpendicular second wall;
a dispensing slot positioned in the perpendicular second wall; and
one or more product support tabs positioned in the perpendicular second wall at a distance away from the planar edge of the first wall and the second wall;
wherein the one or more product support tabs are folded within the perpendicular second wall to contact and support a portion of the number of sheet products therein.

* * * * *